US006840551B2

(12) United States Patent
Evans

(10) Patent No.: US 6,840,551 B2
(45) Date of Patent: Jan. 11, 2005

(54) OVER-CENTER LATCH

(75) Inventor: Norman Evans, Redditch (GB)

(73) Assignee: Howard S Cooke & Co Limited, Worcestershire (GB)

( * ) Notice: Subject to any disclaimer, the term of this patent is extended or adjusted under 35 U.S.C. 154(b) by 0 days.

(21) Appl. No.: 10/311,551

(22) PCT Filed: Jun. 18, 2001

(86) PCT No.: PCT/GB01/02672

§ 371 (c)(1),
(2), (4) Date: May 9, 2003

(87) PCT Pub. No.: WO01/98610

PCT Pub. Date: Dec. 27, 2001

(65) Prior Publication Data

US 2003/0168866 A1 Sep. 11, 2003

(30) Foreign Application Priority Data

Jun. 17, 2000 (GB) ..... 0014812

(51) Int. Cl.[7] ..... E05C 5/00

(52) U.S. Cl. ..... 292/113; 292/247; 292/336.3; 24/68 CD

(58) Field of Search ..... 292/113, 247, 292/336.3; 24/68 CD, 909, 170; 70/73

(56) References Cited

U.S. PATENT DOCUMENTS 2,710,214 A * 6/1955 Mills ..... 292/247
2,795,946 A 6/1957 Check
2,994,934 A 8/1961 Kraus
3,584,906 A 6/1971 Budzyn
3,602,723 A * 8/1971 Swanson ..... 292/113
3,818,548 A * 6/1974 Meyerson ..... 24/170
3,826,473 A * 7/1974 Huber ..... 242/388.3
3,892,434 A * 7/1975 Caldwell ..... 292/247
3,998,481 A 12/1976 Anthone
4,243,255 A 1/1981 Hornak
4,428,608 A 1/1984 Cooke et al.
4,755,144 A * 7/1988 Gordon et al. ..... 439/37
5,131,246 A 7/1992 Bonzer
5,154,400 A * 10/1992 Rotharmel ..... 242/388.3

OTHER PUBLICATIONS

Patents Act 1977, Search Report under Section 17, Date of Search: Oct. 27, 2000.

* cited by examiner

*Primary Examiner*—Gary Estremsky
(74) *Attorney, Agent, or Firm*—Carlson, Gaskey & Olds

(57) ABSTRACT

An over-centre latch (8) comprising a base plate (10) defining a plane of attachment (P), a pivotally mounted lever (16), and a claw (24) pivotally mounted to the lever, in use the claw operably engaging a catch plate in order to close the latch, wherein a safety catch, comprising a catch member (42) pivotably moveable to an engaged position about an axis that is generally orthogonal to the plane of attachment when the latch is closed, operably prevents opening of the latch when the catch member is in the engaged position.

22 Claims, 9 Drawing Sheets

FASTENER IN CLOSED POSITION

FASTENER IN OPEN POSITION

FASTENER IN CLOSED POSITION

FASTENER IN OPEN POSITION

OVER-CENTER LATCH

Figure 1:
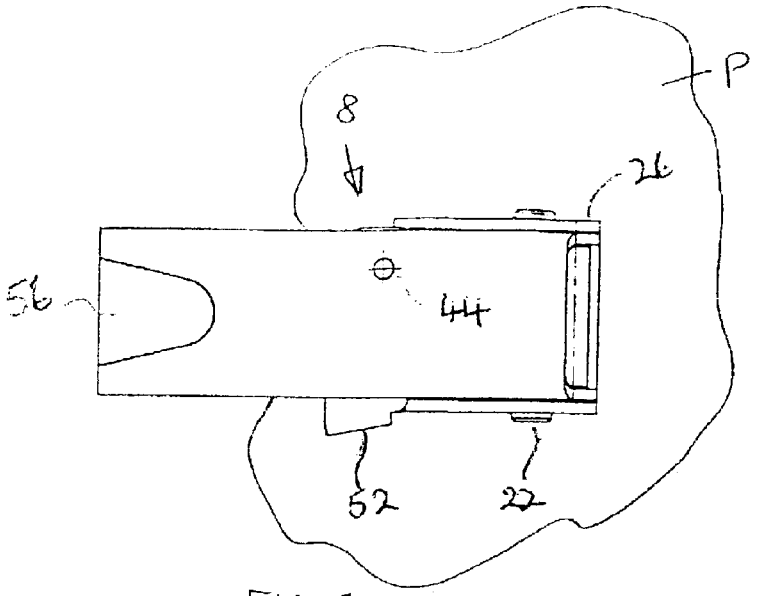

This invention relates to over-centre latches, particularly such latches used to fasten lids and doors to cases and other equipment.

Over-centre latches are well known in the field of fasteners and are typically used to fasten hinged lids or doors on cases, and other articles including items of machinery. They may also be used as part of a band clamp or strap securing system. Over-centre latches generally comprise a base plate a pivotally mounted lever, a claw pivotally mounted to the lever and a catch plate. In use, one end of the claw engages the catch plate and is locked in position by an over-centre action by moving the lever about its pivot on the base plate. Simple over-centre latches are prone to become unfastened through the inadvertent movement of the lever. Such inadvertent opening may be prevented by incorporating a safety catch feature wherein the lever may be locked in its closed position. One type of safety-catch uses a curved sheet of resilient material one end of which is attached to the base plate and the other end of which engages a slot in an upper face of the lever. While such safety catches are effective, they can require a considerable force, usually applied by the thumb of a user, to release them and are therefore awkward to use. Furthermore since the resilient member projects from the face of the lever, it is possible to be inadvertently knocked risking unlatching of the latch. While more complex alternatives to this simple safety catch are known these often require a combination of several machined parts, and are thus relatively expensive to manufacture.

An object of the present invention is to provide an improved over-centre latch. Another object is to provide an over-centre latch with a safety catch that may be readily disengaged. A further object of the invention is to provide an over-centre latch with a safety catch that is simple and inexpensive to manufacture. A further object of the invention is to provide an over-centre latch which is stronger than known latches.

According to the present invention there is provided an over-centre latch comprising a base plate defining a plane of attachment, a pivotally mounted lever, and a claw pivotally mounted to the lever, in use the claw operably engaging a catch plate in order to close the latch, wherein a safety catch, comprising a catch member pivotally moveable to an engaged position about an axis that is generally orthogonal to the plane of attachment when the latch is closed, operably prevents opening of the latch when the catch member is in the engaged position, in which the lever or base plate have a generally first U-shaped cross section defined by two first side portions and a first connecting portion, wherein the two first side portions each have a first slot within which the catch member moves.

According to further aspects of the present invention those provided an over-centre latch comprising a base plate defining a plane of attachment, a pivotally mounted lever, and a claw pivotally mounted to the lever, with the lever being pivotally mounted to a bolt member that slideably engages the base plate, in use the claw operably engaging a catch plate in order to close the latch, wherein a safety catch, comprising a catch member pivotally moveable to an engaged position about an axis that is generally orthogonal to the plane of attachment when the latch is closed, operably prevents opening of the latch when the catch member is in the engaged position, in which the bolt member has a first generally u-shaped cross section defined by two first side portions and a first connecting portion wherein the two first side portions each have first slots within which the catch member moves.

Figure 2:
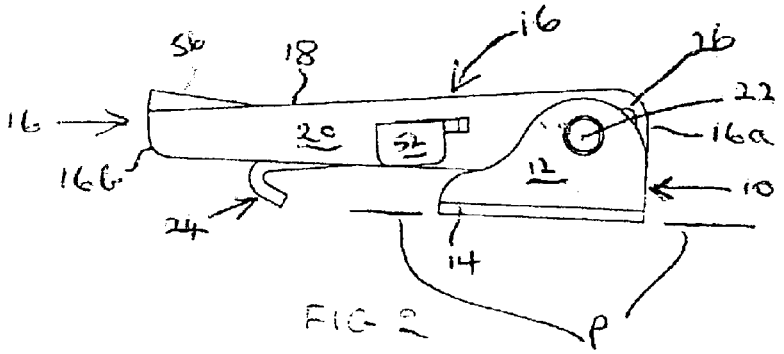
Figure 3:
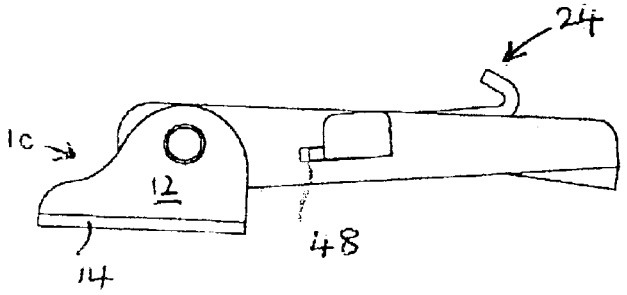
Figure 4:
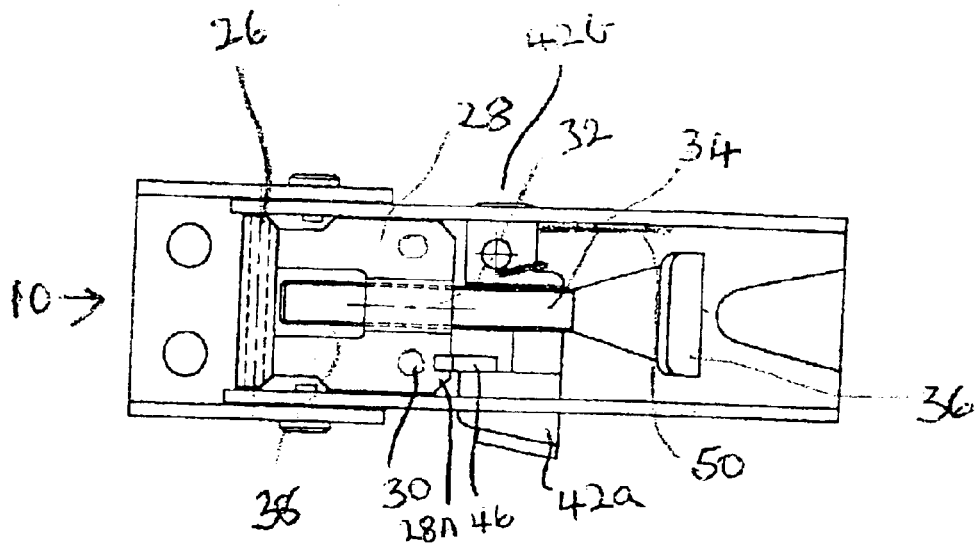
Figure 5:
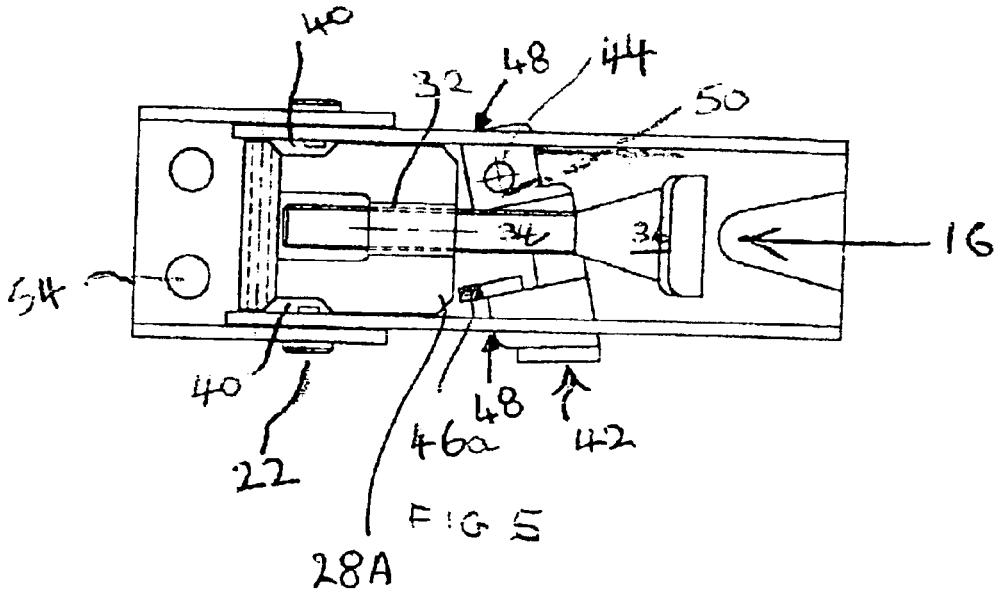
Figure 6:
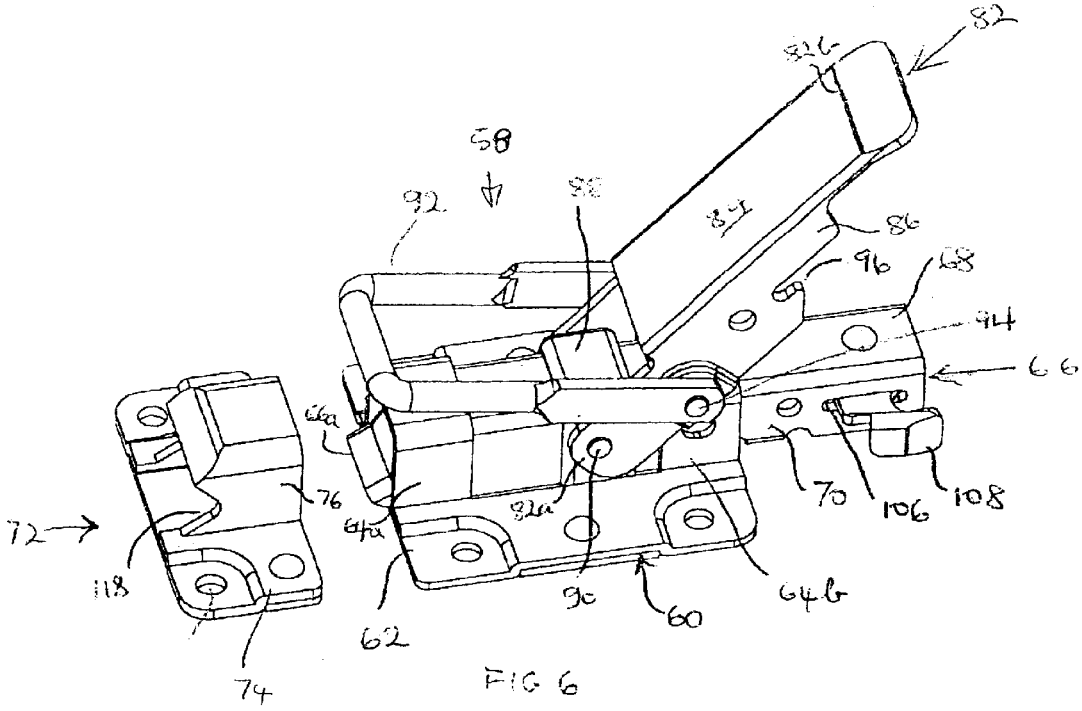
Figure 7:
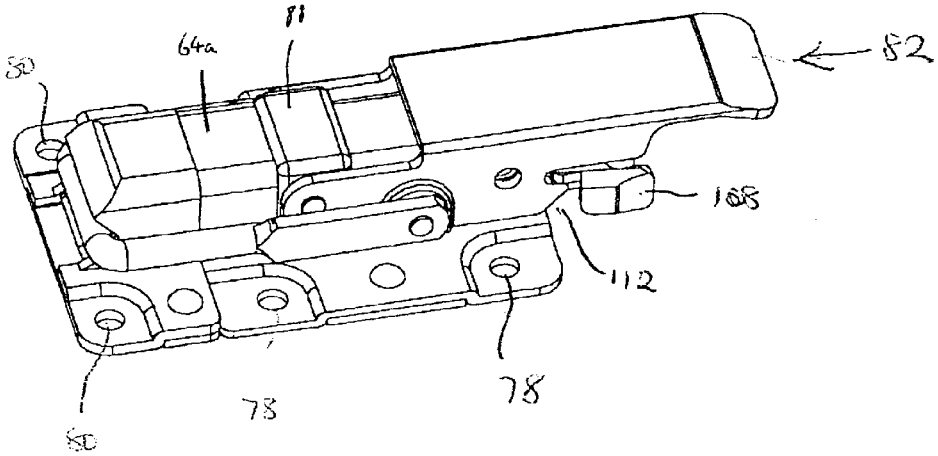
Figure 8:
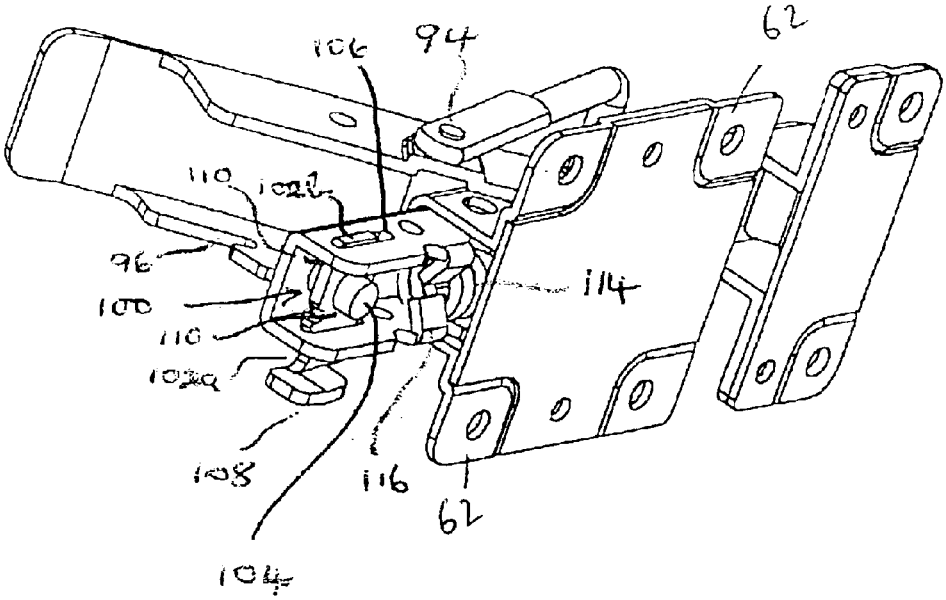
Figure 9:
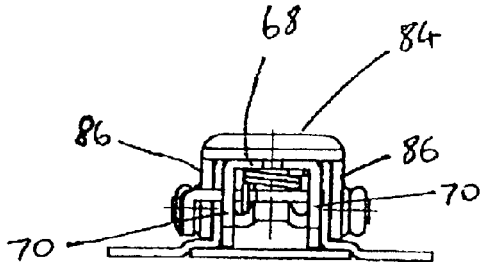
Figure 10:
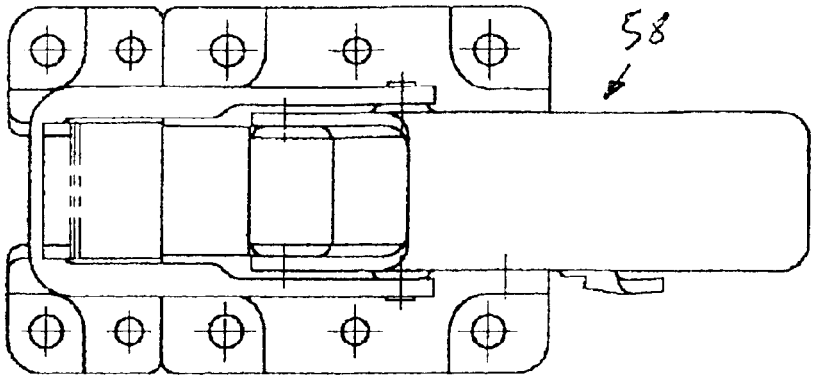
Figure 11:
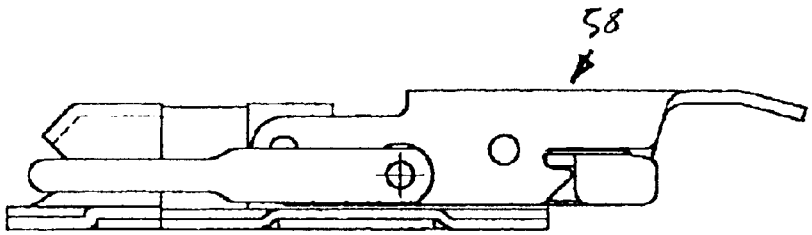
Figure 12:
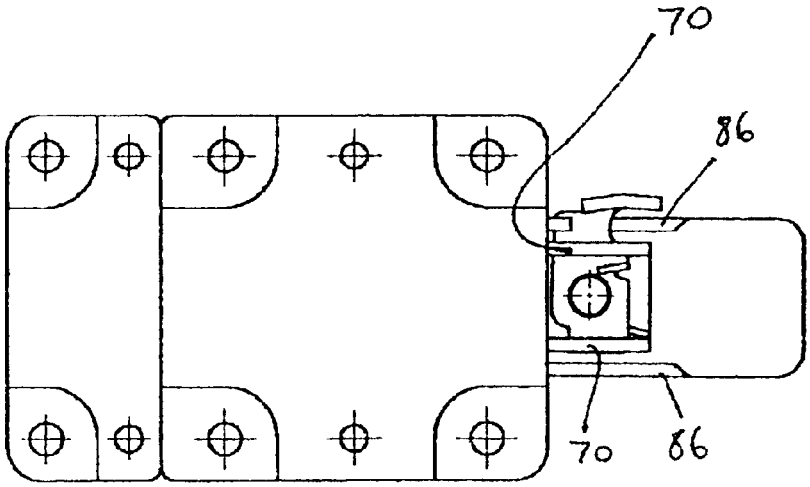
Figure 13:
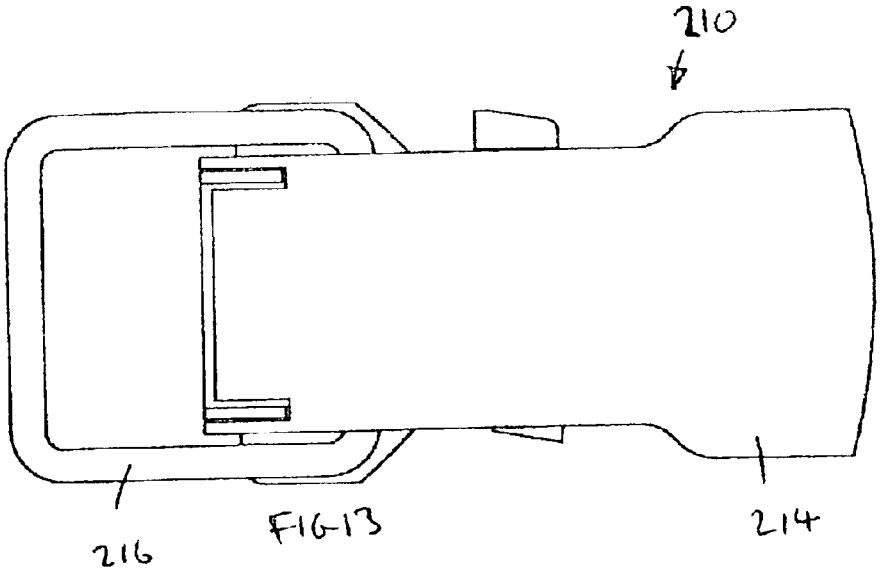
Figure 14:
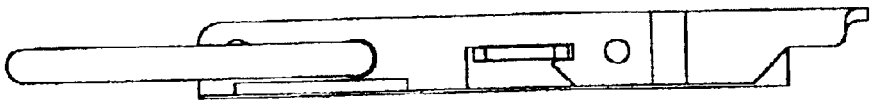
Figure 15:
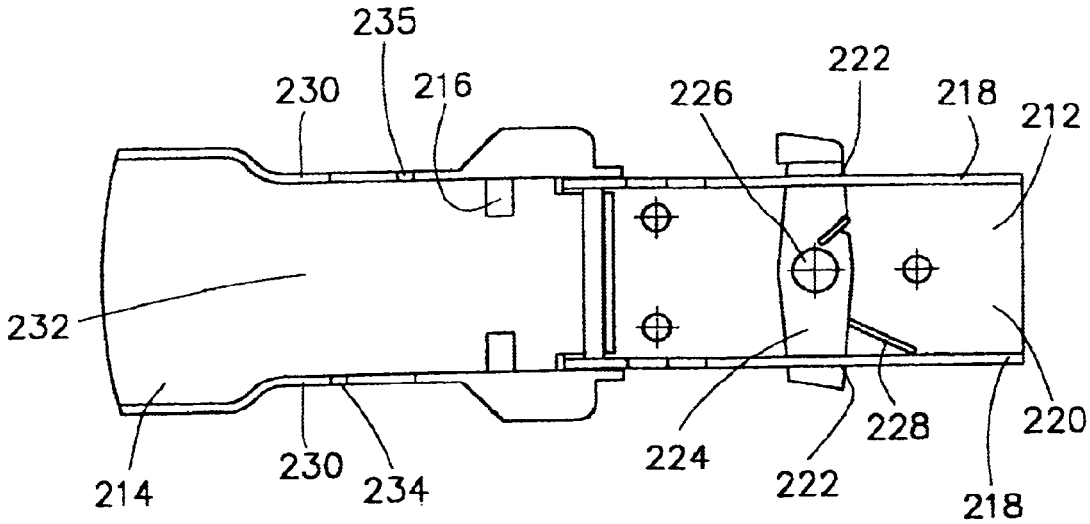
Figure 16:
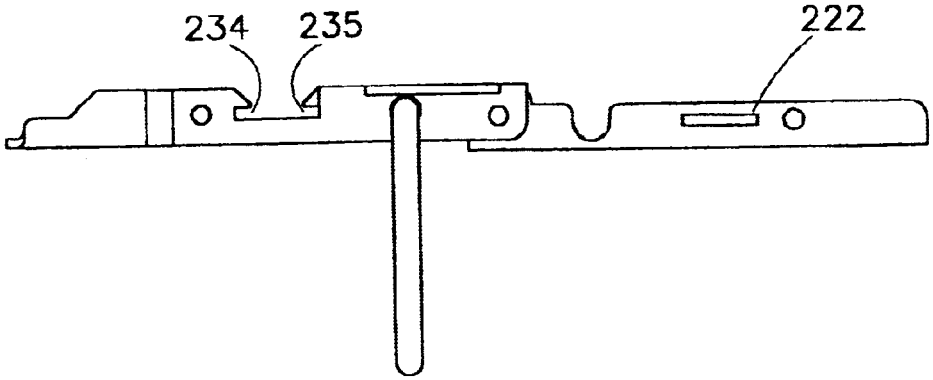
Figure 17:
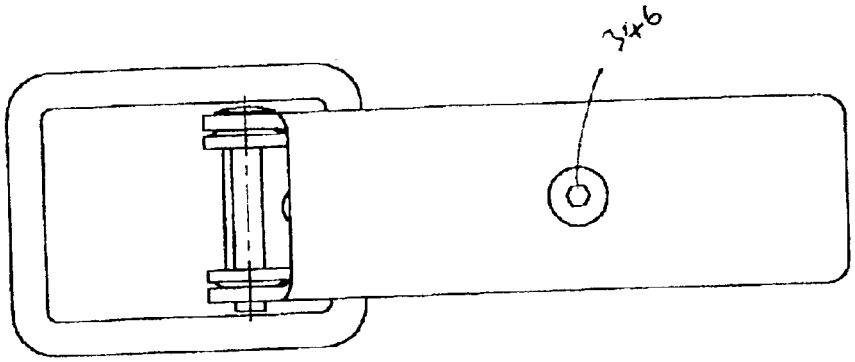
Figure 18:
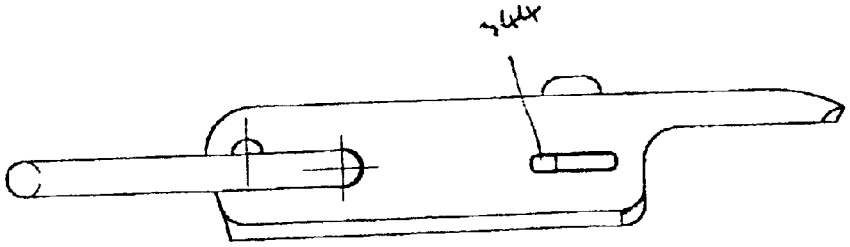
Figure 19:
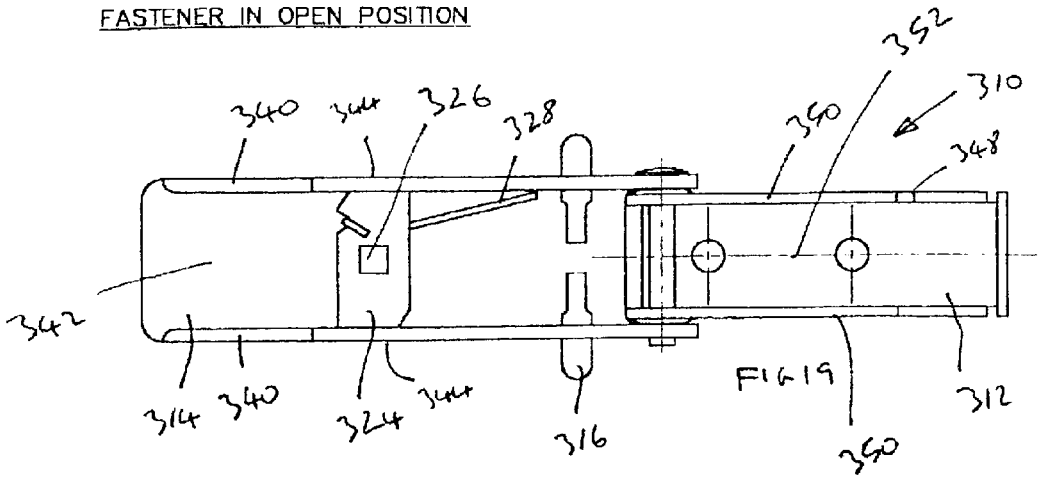
Figure 20:
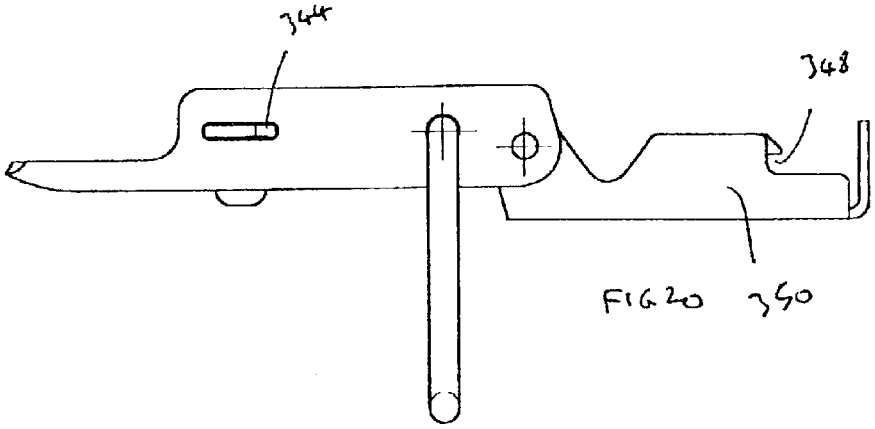
Figure 1:
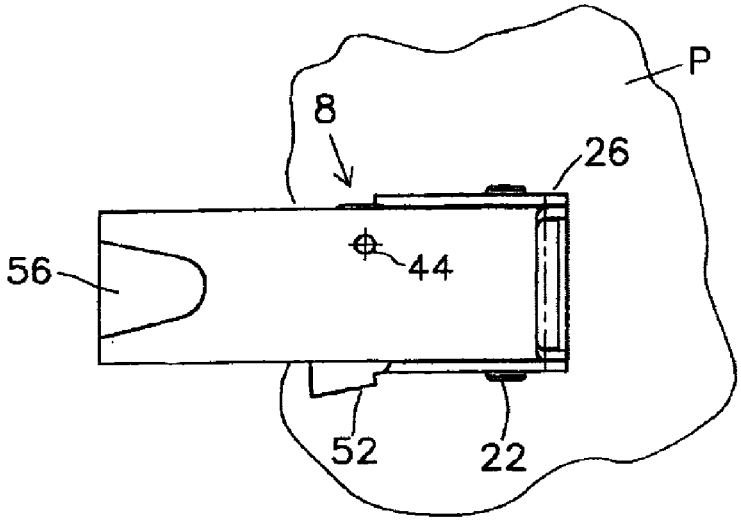
Figure 2:
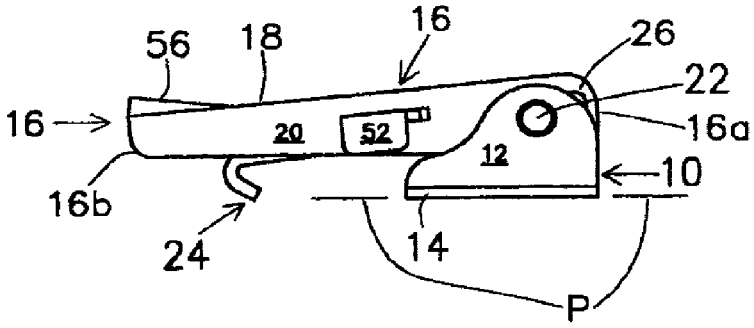
Figure 3:
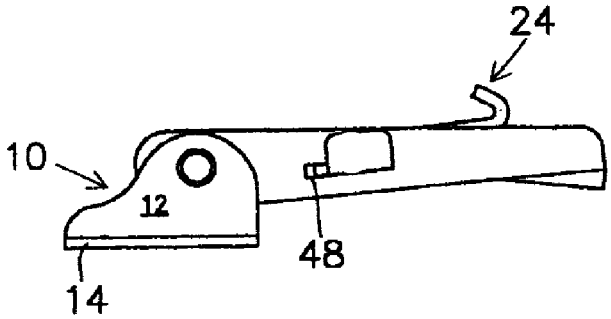
Figure 4:
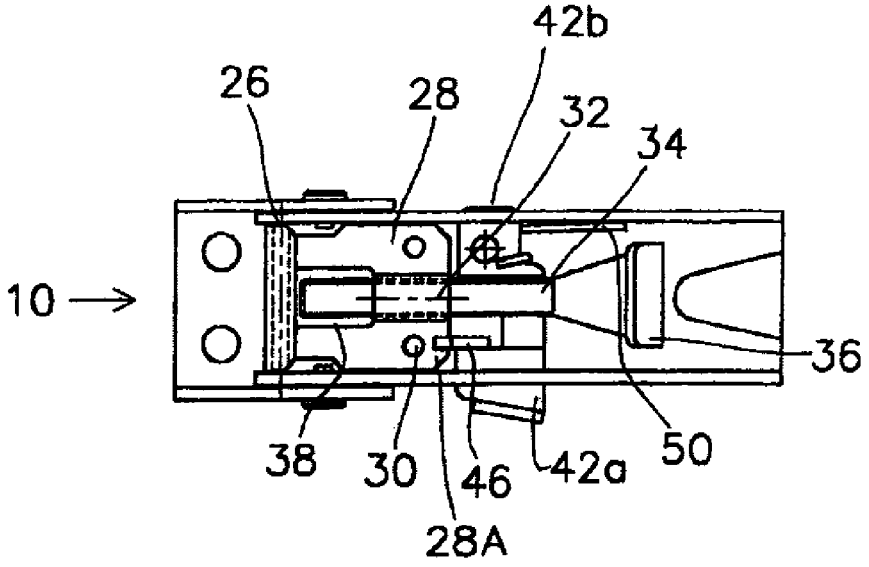
Figure 5:
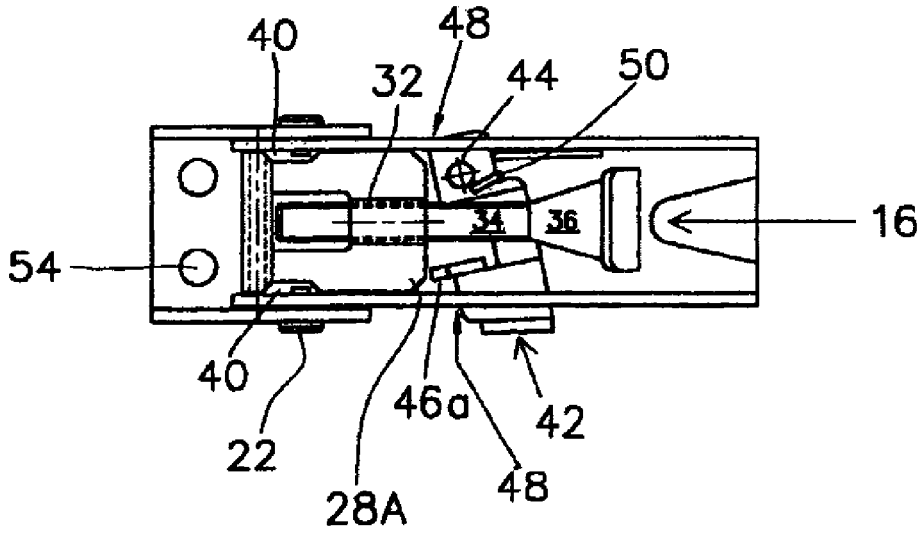
Figure 6:
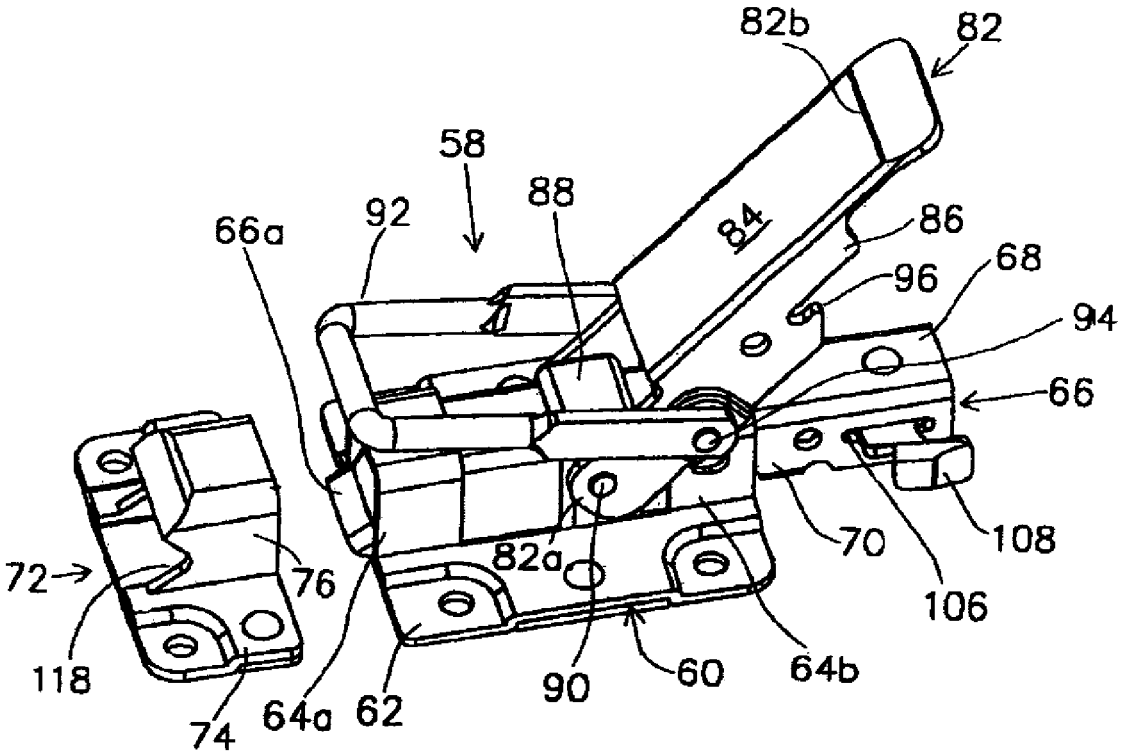
Figure 7:
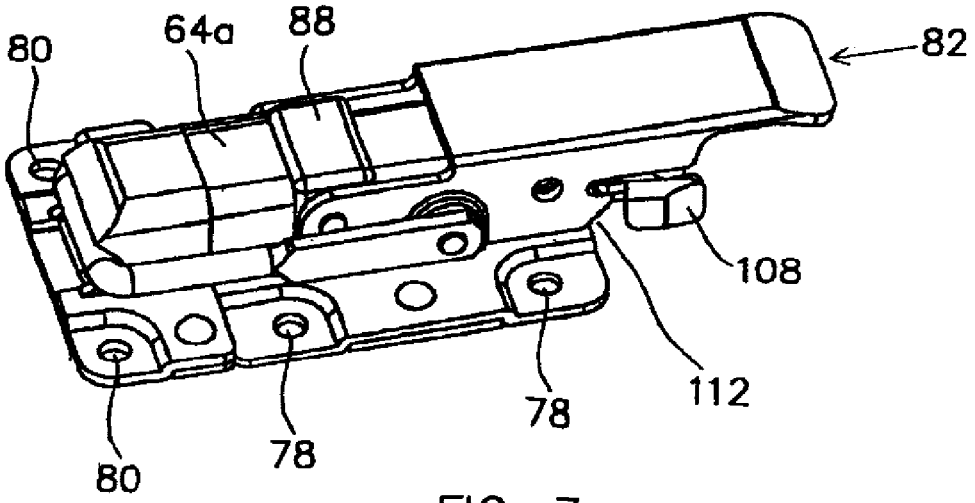
Figure 8:
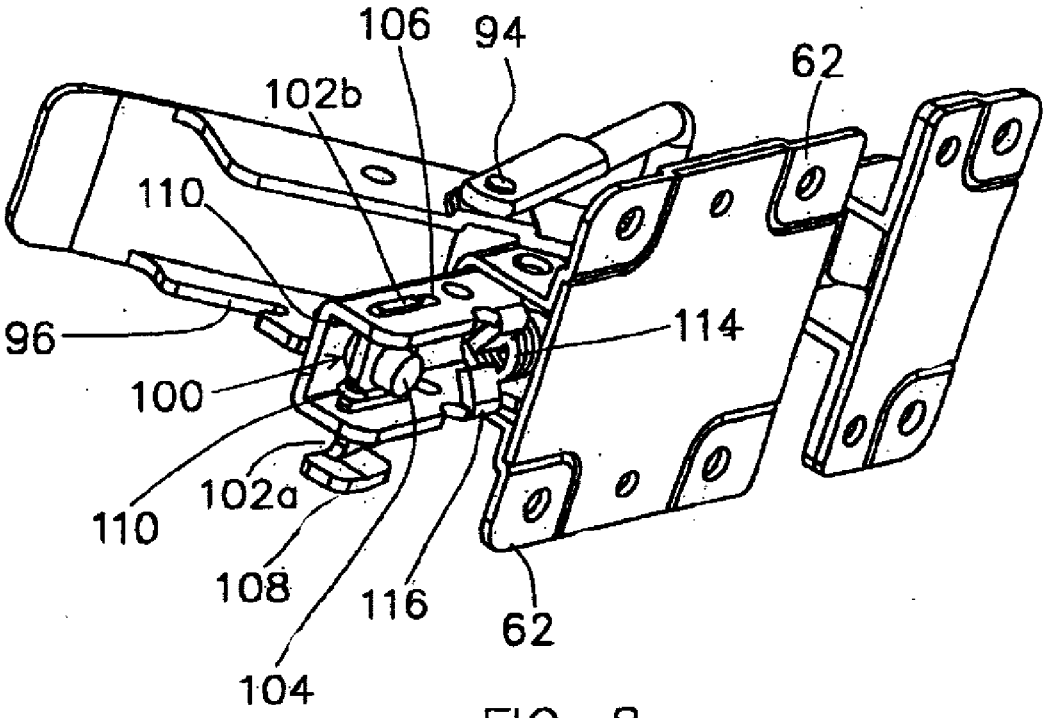
Figure 9:
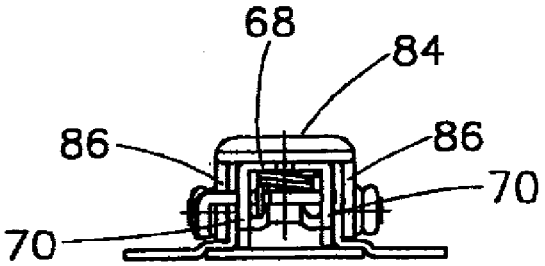
Figure 10:
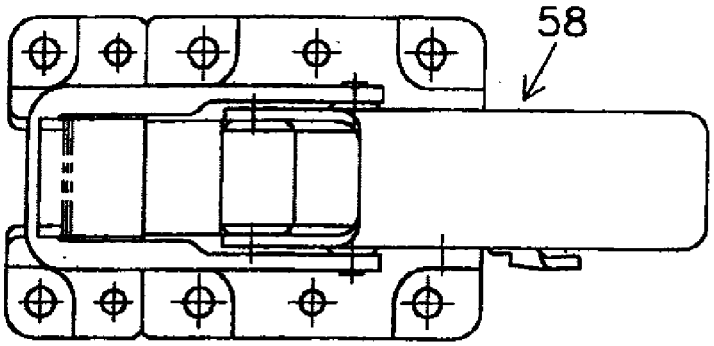
Figure 11:
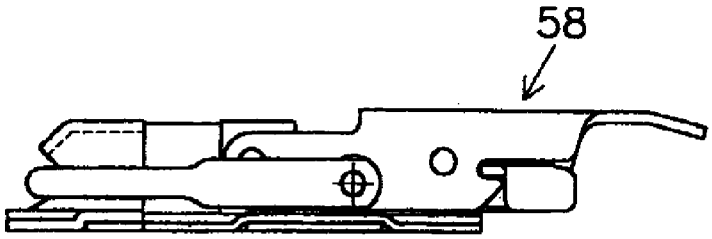
Figure 12:
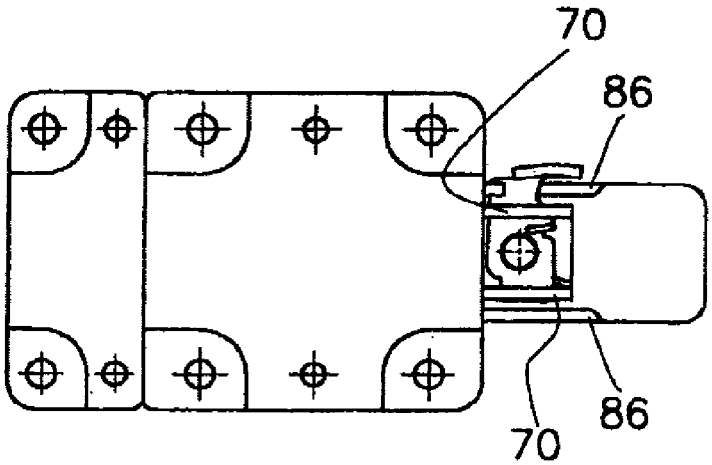
Figure 13:
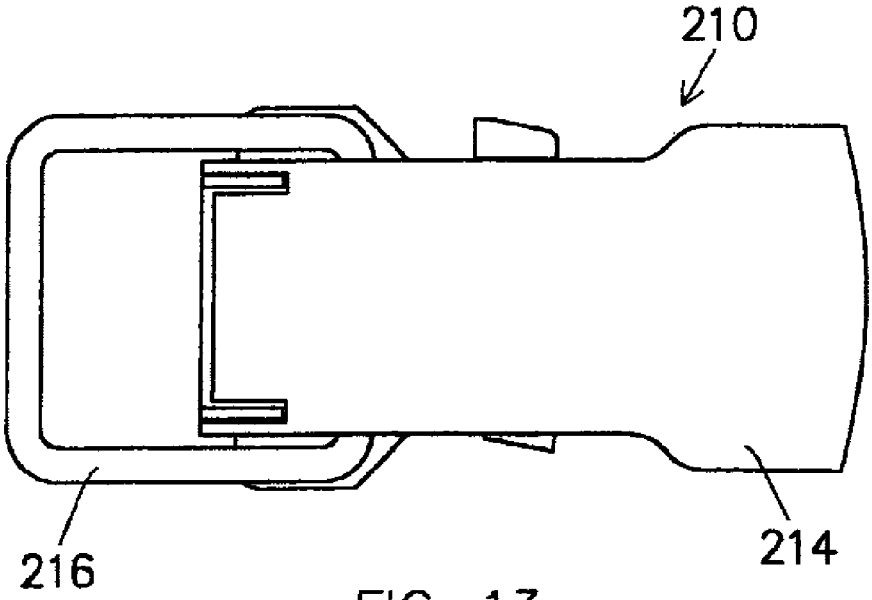
Figure 14:
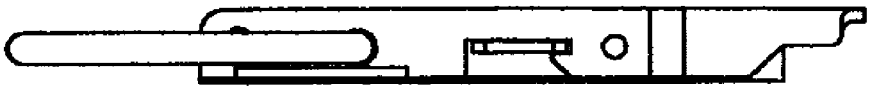
Figure 15:
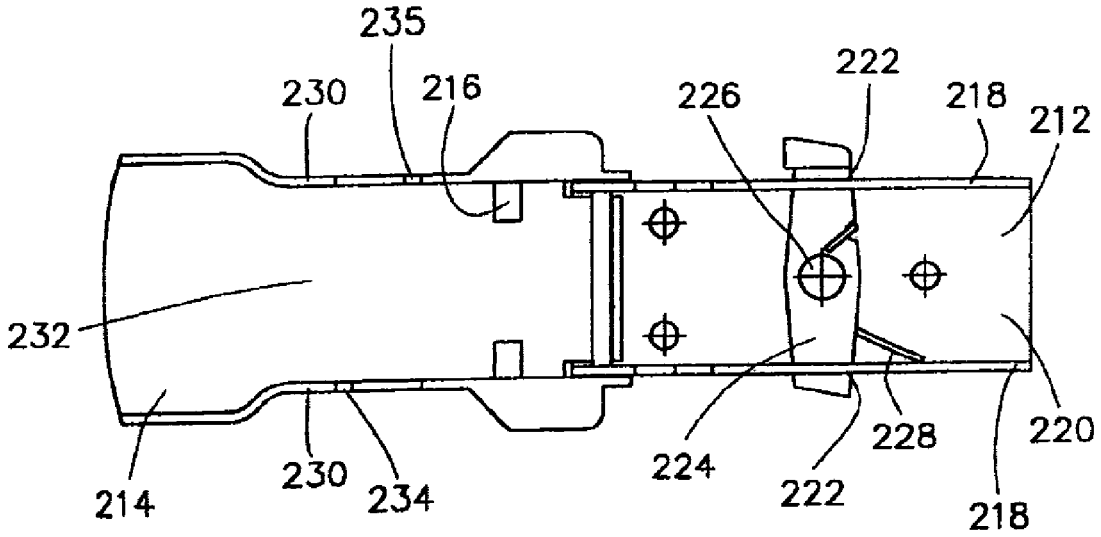
Figure 16:
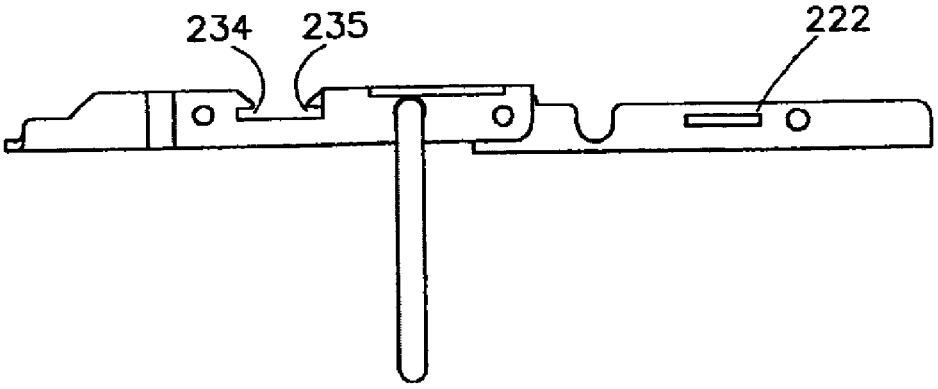
Figure 17:
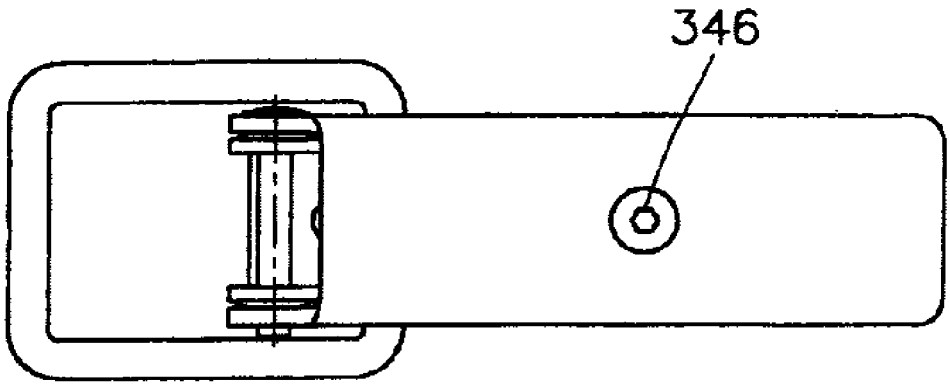
Figure 18:
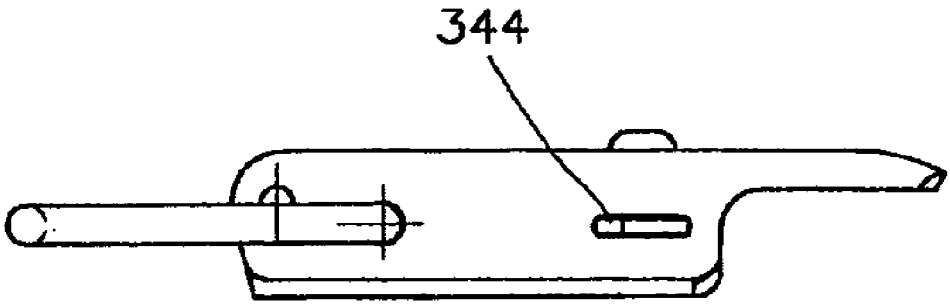
Figure 19:
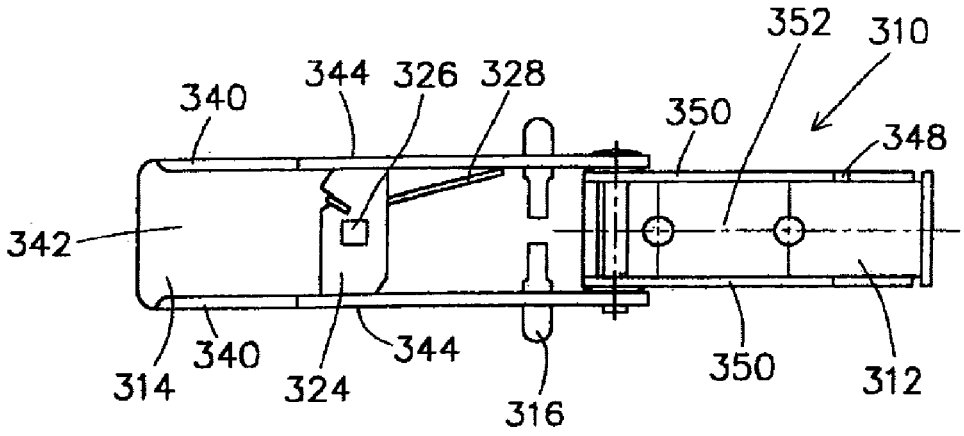
Figure 20:
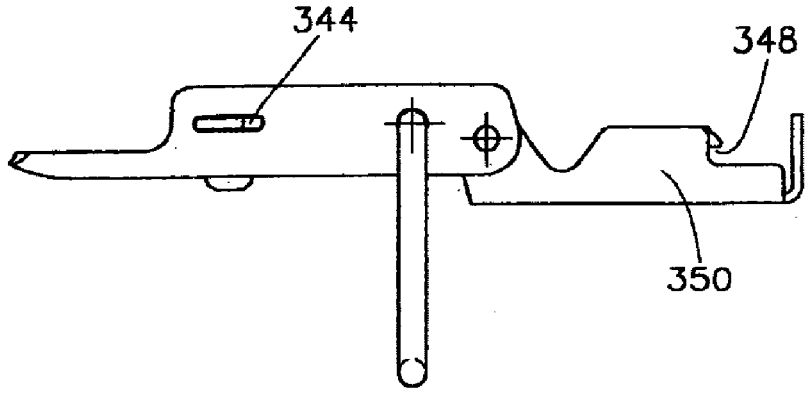

Embodiments of the invention will now be described, by way of example only, with reference to the following drawings in which:

FIG. 1 is a plan view of a over-centre latch according to the invention (excluding catch plate) in a closed position, FIG. 2 is a side view of the over-centre latch of FIG. 1 in a closed position, FIG. 3 is a side view of the over-centre latch of FIG. 1 in an open position, FIG. 4 is an underside view of the over-centre latch of FIG. 1 with the safety catch engaged, FIG. 5 is an underside view of the over-centre latch of FIG. 1 with the safety catch disengaged, FIG. 6 is a perspective view of another embodiment of the invention showing an over-centre latch in an open position, FIG. 7 is a perspective view of the over-centre latch of FIG. 6 in the closed position, FIG. 8 is a perspective view of the underside of the over-centre latch of FIG. 6, FIG. 9 is a cross section view of the over-centre latch of FIG. 6, FIGS. 10 to 12 are plan and side elevation views of the over centre latch of FIG. 6, FIGS. 13 and 14 are plan and side elevation views of a further embodiment of an over-centre latch according to the present invention, FIGS. 15 and 16 are plan and side elevation views of the over-centre latch of FIG. 13 in an open position, FIGS. 17 and 18 are plan and side elevation views of a further embodiment of an over-centre latch according to the present invention, and FIGS. 19 and 20 are plan and side elevation views of the over-centre latch of FIG. 17 shown in an open position.

In a first embodiment (see FIGS. 1 to 5) the invention provides an over-centre latch 8 with a generally "U shaped" base plate 10 comprising two side walls 12 and base portion 14. Base portion 14 defines a plane of attachment P of the latch to a case the like. The latch further includes a lever 16 with two first side portion 20 jointly a first connecting portion 18, pivotally mounted proximal to a first end 16*a* by rivets 22 passing through holes in side walls 12 and side faces 20 such that the lever 16 may pivot in a direction orthogonal to the plane of the side walls 12. Lever 16 has a generally first "U-shaped" cross section. A claw 24 is pivotally mounted close to the first end 16*a* of lever 16 by means of pin 26 that engages holes in side portion 20 of lever 16 and allows hinge portion 28 of claw 16 to pivot in a direction orthogonal to the plane of the side walls 12. An over-centre action is provided by ensuring that the pivotal axis of the lever 16 lies between the pivot axis of the claw and the second end 16*b* of the lever 16 when the lever is in a closed position (FIG. 2). The hinge portion 28 of claw 24 may be formed by folding a single sheet of material around pin 28 and fixing the ends with rivets 30, a female threaded portion 32 being provided between rivets 30 to engage threaded shaft 34 that extends to hook portion 36 of claw 16. Hinge portion 28 has a rectangular hole 38 and has slots 40 sized so that the claw may pivot without touching the inside portions of rivets 22.

A safety catch comprising a catch member 42 is mounted so that it may pivot about pin 44 the axis of which is generally orthogonal to the plane of attachment when the latch is in the closed position. Pin 44 passes through a hole near one end of the catch member 42 and a notch 46 is provided near the other end of the catch member 42. Portions 42*a* and 42*b* of catch member 42 pass through first slots 48 located in first side portions 20 of lever 16, thus preventing the catch member from sliding off pin 44. When the safety catch is in an engaged position notch 46 hangs over the distal end face 28A of hinge portion 28 (see FIG. 4) and the latch is locked. A resilient spring 50 is provided to bias the catch member 42 toward this engaged position.

The safety catch may be readily disengaged (see FIG. 5) thereby unlocking the latch by applying moderate finger or thumb pressure to a thumb portion 52 that extends from end 42*a* of the catch member, thus pivoting the catch member about pin 44 so that the notch 46 moves clear of hinge portion 28 thereby allowing pivotal movement of lever 16 to open the latch. Notch 46 has a ramped portion 46*a* that momentarily pushes catch member 42 to the disengaged position (see FIG. 5) as the lever is pivoted towards the claw (see below).

Base plate 10 is provided with several holes 54 to facilitate fixing, for example to a case. A catch plate (not shown) of conventional design would be fixed to a lid or door of the case so that in the closed position the claw may engage the catch plate in the normal manner. Lever 16 may have a raised portion 56 on the top face 18 of its second end to facilitate gripping of the lever.

In use, lever 16 is pivoted away from claw 24, typically through an angle of about 180°, claw 24 is engaged in a catch plate in the normal manner. It should be noted that in this position the resilient spring biases the catch member, which biasing action is resisted by the catch member contacting an end one of the first slots 48. Lever 16 is then pivoted towards claw 24 until it is in the position shown in FIG. 2. During the last part of this pivoting movement the distal end face 28A of hinge portion 28 engages ramp portion 46*a* of notch 46 and thereby momentarily urges the catch to its disengaged position, prior to the hinge member being seated against the inside of top face 18 of lever 16 and notch 46 moving to an engaged position where it overhangs the distal end face of hinge portion 28, thus locking the latch in a "slam" or "snap shut" manner.

It should also be noted that when the catch member is moved by thumb pressure to an open position opposite ends of slot 48 can act to limit pivotal movement of the catch member.

In another embodiment the invention takes the form of an over-centre latch 58 incorporating a bolt mechanism (see FIGS. 6-8). A base plate 60 defining a plane of attachment comprises flange portions 62 and mid portions, of quadrangular cross section 64*a* and 64*b* at each end, housing a bolt member 66. Bolt member 66 has two first side portions 70 joined by a first connecting portion 68, formed from sheet material and having a generally first U-shaped cross section. Bolt 66 is slideably mounted within base plate 60 such that when the latch is in the closed position the tapered first end 66*a* of the bolt engages catch plate 72. Catch plate 72 comprises flange portions 74 and a mid portion 76 of quadrangular cross section and sized to operably engage first end 66*a* of the bolt.

Between mid portions 64*a* and 64*b* there is a space in the base plate 60 provided to allow movement of an enlarged portion 88 of the bolt (see below). Base plate 60 and catch plate 72 have fixing holes 78 and 80 respectively. A lever 82 comprising two opposing second side portions 86 joined by a second connecting portion 84 is formed from sheet material and having a generally second U-shaped cross section. The lever 82 is pivotally mounted to the enlarged portion 88 of the bolt 66 by rivets 90 that locate holes located proximal to first end 82*a* of the lever. Enlarged portion 88 in combination with mid portions 64*a* and 64*b* of the base plate 60 limits sliding movement of the bolt 66, providing end stops against which the enlarged portion 88 abuts at the extremes of its slide path 66. However, with the over-centre latch in a closed condition there would typically be a small gap of perhaps 1 mm between enlarged portion 88 and mid portion 64*a* to ensure the latch can always close properly.

A generally U-shaped claw or clasp 92 is pivotably mounted by rivets 94 to the side faces 86 of the lever at points between rivets 90 and the second end 82*b* of the lever 82. As described in the earlier embodiment this feature provides the required over-centre action. A second slot 96 is provided in one second side portion 86 of the lever for engagement with a safety catch mechanism (see below).

A safety catch 100 (see FIG. 8) having a catch member 102 is mounted so that it may pivot about pin 104 the axis of which is orthogonal to the plane of attachment. Pin 104 passes through a hole in the catch member 102 and the ends 102*a* and 102*b* of catch member pass through first slots 106 located in first side portions 70 of bolt 66, thus preventing the catch member from moving axially along pin 104, while allowing limited pivotal movement. A trigger portion 108 extends from end 102*a* of the catch member 102. When the safety catch is in the engaged position trigger portion 108 engages second slot 96. A resilient spring 110 is provided to bias the catch member 102 towards this engaged position. The safety catch may be readily disengaged by applying moderate pressure, applied for example by the thumb of a user, to trigger portion 108, thus pivoting the catch member about pin 104 so that trigger portion 108 moves clear of second slot 96 thereby allowing pivotal movement of lever 82. Below second notch 96, on side face 86 of the lever, a ramped portion 112 is provided such that as lever 82 is moved downwardly to a point near its fully closed position (see FIG. 7) it momentarily pushes trigger 108 backwards to the disengaged position by pivotal movement of the catch member.

The bolt 66 is biased to an open position by means of helical spring 114, located within the U-shaped profile of bolt 66 and held under compression between the inside surface of a flange (not shown) of the base plate 60 and end stops 116 formed by folding protrusions formed in side faces 70 of the bolt along a fold line lying in a direction generally parallel to the axis of helical spring 114.

In use, lever 82 is pivoted away from bolt 66, typically through an angle of about 130°, claw 92 is engaged with notch 118 of catch plate in the normal manner, lever 82 is then pivoted towards bolt 66 until it is in the position shown in FIG. 7. This latches claw 92 over notch 118 and also slides bolt 66, against the biasing action of spring 114, such that the bolt 66 engages catch plate 72. During the last part of this pivoting movement the ramped portion 112 of side face 86 of the lever engages part of trigger portion 108 of the catch member and thereby momentarily urges the catch to its disengaged position, prior to the lever 82 being seated in a nested position (see especially FIGS. 9 and 12)over bolt 66 wherein the catch is urged to its engaged position thus locking the latch. The safety catch 100 may be readily disengaged by applying only moderate thumb or finger pressure against the biasing action of spring 110.

With reference to figures 13 to 16 there is shown a further embodiment of an over-center latch 210 having a base plate 212, a lever 214, and a claw 216 rotatably mounted to the lever. In use of the claw operably engages a catch plate (not shown) in order to close the latch.

The base plate as a generally first U-shaped cross section defined by the first side portions 218 and a first connecting portion 220. The two first side portions each have a first slot 222.

A catch member 224 is mounted rotatably fast with pin 226, with the pin being rotatably mounted on the first connecting portion 220. A spring 228 biases the catch member 224 in an anti-clockwise direction when viewing FIG. 15, which anticlockwise rotation is limited by end of first lots 222.

Lever 224 has a second generally U-shaped cross section defined by two second side portions 230 and a second connecting portion 232. In this case a second side portion 230 includes second slots 234 and 235 for engagement by the catch member 224.

With the latch 210 in a closed position, the first generally U-shape cross section of the base plate faces the second generally U-shaped cross section of the lever. This can be contrasted with the nested position of the U-shaped lever and bolt as shown in FIG. 9.

With reference to figures 17 to 20 there is shown a further embodiment of an over-center latch assembly 310 having a base plate 312, a lever 314, a claw 316, a catch member 324, a pin 326 and a spring 328.

In this case the lever has a generally first U-shaped cross section defined by two first side portions 340 and a first connecting portion 342. The two first side portions each have a first slot 344 within which the catch member moves.

The base plate has a second generally U-shaped cross section defined by two second side portions 350 and a second connecting portion 352.

In this case the catch member is mounted rotatably fast on pin 326. The end of pin 326 remote from the catch member includes a hexagonal recess 346 for engagement by an allen key. Rotation of pin 326 by an allen key or other similar hexagonal ended tool in a clockwise direction when viewing FIG. 17 causes the catch member to disengage second slot 348.

In further embodiments alternative shapes of recess (such as slots, square recesses or posi-drive (RTM) etc could be used, to be operated by appropriate tools. Alternatively, various forms of projection could be used such as hexagonal or square projections to be operated by a spanner or similar tool could be used.

A tool operated safety catch beneficially results in a safety catch that cannot be operated in the absence of an appropriate tool, and in particular cannot be operated simply by the use of fingers.

What is claimed is:

1. An over-center latch comprising a base plate defining a plane of attachment, a pivotally mounted lever, and a claw pivotally mounted to the lever, in use the claw operably engaging a catch plate in order to close the latch, wherein a safety catch, comprising a catch member pivotally moveable to an engaged position about an axis that is generally orthogonal to the plane of attachment when the latch is closed, operably prevents inadvertent opening of the latch when the catch member is in the engaged position, in which the lever has a generally first U-shaped cross section defined by two first side portions and a first connecting portion, wherein the two first side portions each have a first slot within which the catch member moves with the catch member being pivotable with or about a shaft mounted on the first connecting portion of the lever.

2. An over-center latch according to claim 1 wherein the catch member operably engages the claw.

3. An over-center latch according to claim 2 wherein the lever is pivotally mounted to the base plate.

4. An over center latch according claim 1 wherein the catch member operably engages the base plate.

5. An over-center latch according to claim 4 wherein the lever is pivotally mounted to the base plate.

6. An over-center latch according to claim 4 in which the base plate has a second generally U-shaped cross section defined by two second side portions and a second connecting portion wherein the catch member engages a second slot of one of the second side portions of the base plate when the latch is in the closed position.

7. An over-center latch according to claim 6 in which the first generally U-shaped cross section of the lever faces the second generally U-shaped cross section of the base plate when the latch is in the closed position.

8. An over-center latch comprising a base plate defining a plane of attachment, a pivotally mounted lever, and a claw pivotally mounted to the lever, in use the claw operably engaging a catch plate in order to close the latch, wherein a safety catch, comprising a catch member pivotally moveable to an engaged position about an axis that is generally orthogonal to the plane of attachment when the latch is closed, operably prevents inadvertent opening of the latch when the catch member is in the engaged position, in which the base plate has a generally first U-shaped cross section defined by two first side portions and a first connecting portion, wherein the two first side portions each have a first slot within which the catch member moves and wherein the catch member operably self engages the lever with the catch member being pivotable with or about a shaft mounted on the first connecting portion of the base plate.

9. An over-center latch as defined in claim 8 in which, with the over-center latch in a closed position the claw pivot is situated between the lever pivot and the catch member.

10. An over-center latch according to claim 8 wherein the catch member operably engages the lever.

11. An over-center latch according to claim 8 wherein the lever is pivotally mounted to the base plate.

12. An over-center latch according to claim 8 in which the lever has a second generally U-shaped cross section defined by two second side portions and a second connecting portion wherein the catch member engages a second slot of one of the second side portions of the lever when the latch is in the closed position.

13. An over-center latch as defined in claim 12 in which the catch member engages second slots of each of the second side portions of the lever when the latch is in the closed position.

14. An over-center latch according to claim 12 in which the first generally U-shaped cross section of the base plate faces the second generally U-shaped cross section of the lever when the latch is in the closed position.

15. An over-center latch comprising a base plate defining a plane of attachment, a pivotally mounted lever, and a claw pivotally mounted to the lever, with the lever being pivotally mounted to a bolt member that slideably engages the base plate, in use the claw operably engaging a catch plate in order to close the latch, wherein a safety catch, comprising a catch member pivotally moveable to an engaged position about an axis that is generally orthogonal to the plane of attachment when the latch is closed, operably prevents inadvertent opening of the latch when the catch member is in the engaged position, in which the bolt member has a first generally U-shaped cross section defined by two first side portions and a first connecting portion wherein the two first side portions each have first slots within the catch member moves with the catch member being pivotable with or about a shaft mounted on the first connecting portion of the bolt member.

16. An over-center latch according to claim 15 wherein the catch member operably engages the lever.

17. An over-center latch according to claim 15 in which the lever has a second generally U-shaped cross section defined by two second side portions and a second connecting portion wherein the catch member engages a second slot of one of the second side portions of the lever when the latch is in the closed position.

18. An over-center latch as defined in claim 17 in which the first generally U-shaped cross section of the bolt member is nested with the second generally U-shaped cross section of the lever when the latch is in the closed position.

19. An over-center latch according to claim 1 wherein at least one first slot limits pivotable movement of the catch member.

20. An over-center latch according to claim 1 wherein at least one first slot limits actual movement of the catch member.

21. An over-center latch according to claim 1 in which the catch member is operable by a tool.

22. An over-center latch according to claim 1 in which the catch member is pivotable with the shaft mounted on the first connecting portion of the lever, in which the catch member is operably by a tool and the tool engages the shaft.

* * * * *

UNITED STATES PATENT AND TRADEMARK OFFICE

CERTIFICATE OF CORRECTION

PATENT NO. : 6,840,551 B2
DATED : January 11, 2005
INVENTOR(S) : Evans

It is certified that error appears in the above-identified patent and that said Letters Patent is hereby corrected as shown below:

Replace the drawing sheets 1-9 with the attached 9 sheets of formal drawings.

Signed and Sealed this

Twenty-fourth Day of May, 2005

JON W. DUDAS
*Director of the United States Patent and Trademark Office*

FASTENER IN CLOSED POSITION

FASTENER IN OPEN POSITION

FASTENER IN CLOSED POSITION

FASTENER IN OPEN POSITION